US006227080B1

(12) United States Patent
Grayo et al.

(10) Patent No.: US 6,227,080 B1
(45) Date of Patent: May 8, 2001

(54) VICE-GRIP PLIERS

(75) Inventors: Lucien Roger Grayo, Annet; Jean-Paul Zerkovitz, deceased, late of Lardy, by Marlène Kerkovitz, legal representative; by Yves Zerkovitz, legal representative, Paris; by Anne Parovel, legal representative, Lardy, all of (FR)

(73) Assignee: Facom, Morangis cédex (FR)

( * ) Notice: Subject to any disclaimer, the term of this patent is extended or adjusted under 35 U.S.C. 154(b) by 0 days.

(21) Appl. No.: 08/983,447

(22) PCT Filed: Jul. 12, 1996

(86) PCT No.: PCT/FR96/01091

§ 371 Date: Feb. 5, 1999

§ 102(e) Date: Feb. 5, 1999

(87) PCT Pub. No.: WO97/02926

PCT Pub. Date: Jan. 30, 1991

(30) Foreign Application Priority Data

Jul. 13, 1995 (FR) ..... 95 08553

(51) Int. Cl.[7] ..... B25B 7/12

(52) U.S. Cl. ..... 81/368; 81/370

(58) Field of Search ..... 81/368–372

(56) References Cited

U.S. PATENT DOCUMENTS

| | | | | |
|---|---|---|---|---|
| 2,532,659 | | 12/1950 | Burns . | |
| 2,711,663 | * | 6/1955 | Petersen | 81/370 |
| 2,853,910 | | 9/1958 | Petersen . | |
| 3,958,468 | | 5/1976 | Weller . | |
| 5,014,578 | | 5/1991 | Flentge . | |
| 5,233,893 | * | 8/1993 | Schmidt | 81/368 |

FOREIGN PATENT DOCUMENTS 2 072 081 9/1981 (GB) .

* cited by examiner

*Primary Examiner*—James G. Smith
(74) *Attorney, Agent, or Firm*—Wenderoth, Lind & Ponack, L.L.P.

(57) ABSTRACT

Locking grips (1) designed so that their latch lock mechanism (8) cannot travel beyond a point of alignment of its three points but locks, slightly set back with respect to this alignment, by the snap-fastening of a relief (30) of a catch (28) borne by a lever (10) behind a tooth (19) of a front end of a link (13). The catch (28) forms a trigger (28A) which allows the locking grips to be opened in a controlled way after the lever (10) has been released.

20 Claims, 5 Drawing Sheets

-38-

VICE-GRIP PLIERS

BACKGROUND OF THE INVENTION

The present invention relates to locking grips of the type that allow a strong clamping force to be exerted for a long period of time, without intervention from the operator, on an object, or more frequently on two objects which need to be held together.

In order to give the tool a stable clamped position, a conventional latch lock or toggle mechanisms are designed to travel slightly beyond alignment at the end of clamping, relying for this on the elasticity of the parts. This leads to a serious drawback i.e. unclamping that of the locking grips leads to a sudden release of the elastic energy stored up during clamping, and this sudden release may cause an impact, which may be violent and dangerous, in the operator's hand.

SUMMARY OF THE INVENTION

The object of the present invention is to eliminate this drawback by providing locking grips of simple and ergonomic design that the operator can open while maintaining perfect control over this opening. In particular, if clamping has been achieved with just one hand, the operator will be able to open the locking grips with just one hand.

BRIEF DESCRIPTION OF THE DRAWINGS

Embodiments of the present invention will now be described with reference to the appended drawings, in which.

DETAILED DESCRIPTION OF THE INVENTION

Figures 1, 2:
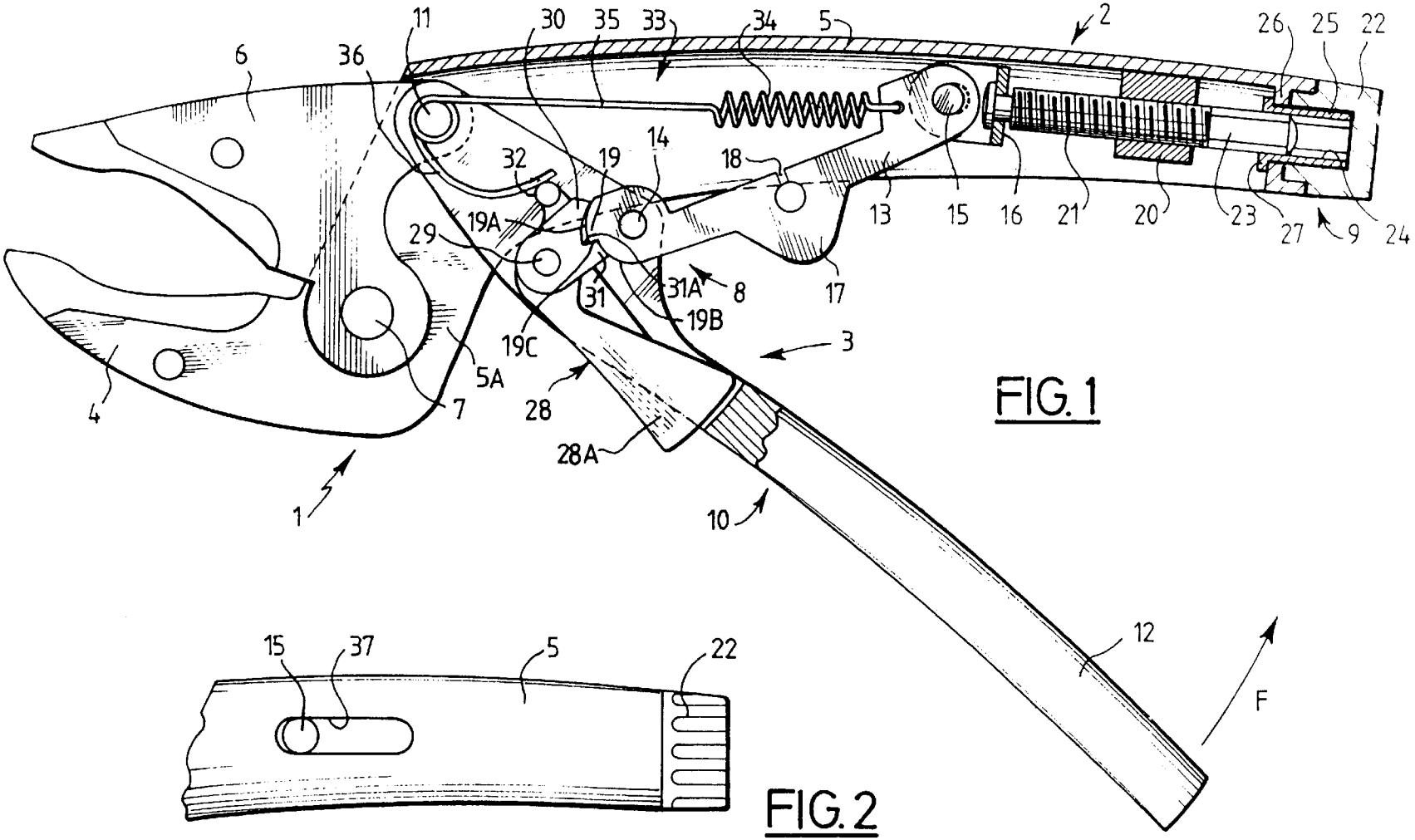
FIG. 1 is a view in longitudinal section of locking grips in accordance with the invention, in the wide-open position, and adjusted to clamp an object of minimum thickness.
FIG. 2 is a corresponding exterior view of the stationary handle.
Figure 3:
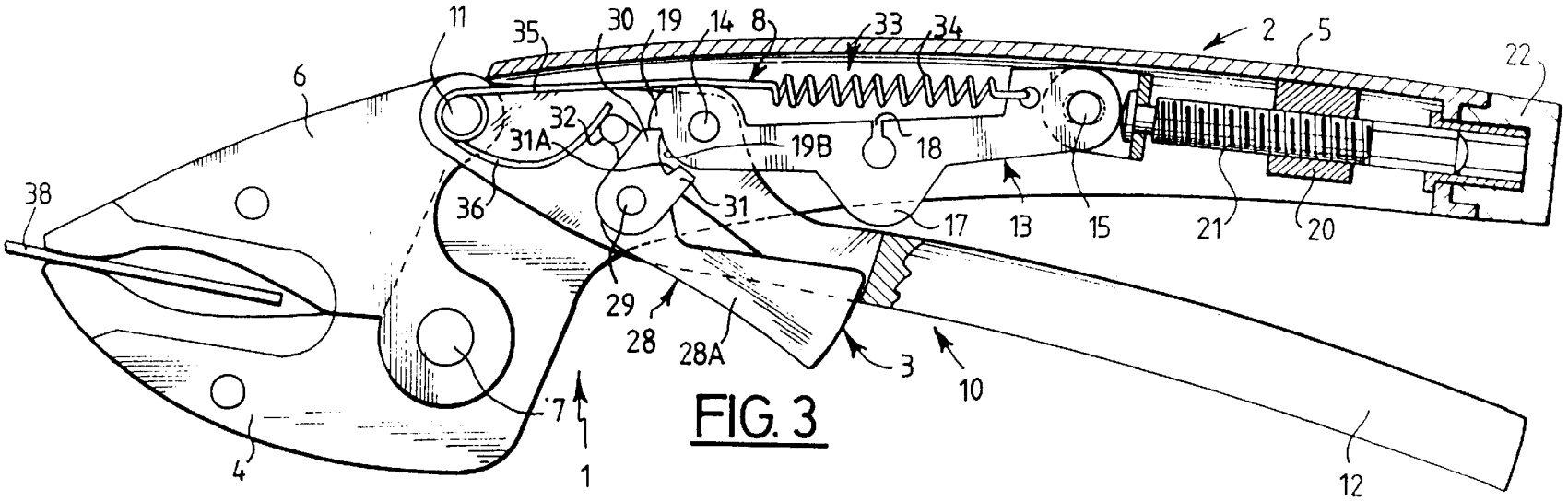
FIG. 3 is a view similar to FIG. 1 showing the locking grips in the clamped position.

The locking grips 1 depicted in FIGS. 1 to 3, which are of a flat overall shape, consist of a stationary assembly 2 and a movable assembly 3.

The stationary assembly 2 has the overall shape of a very elongate S which has a distal or front end part 4 constituting a stationary jaw, a proximal or rear end part 5 which is more or less parallel to the part 4 and constitutes a first handle or stationary handle, and an intermediate connecting part 5A.

In the normal position of use depicted, the jaw 4 is lower down than the handle 5.

The movable assembly 3 comprises a movable or moving jaw 6 of triangular overall shape, and a toggle or latch lock mechanism S equipped with an adjusting device 9. The lower rear vertex of the moving jaw 6 is articulated to the root of the stationary jaw by a pivot 7.

The latch lock mechanism 8 comprises an operating lever 10, the front end of which is articulated to the upper rear vertex of the moving jaw by a pivot 11, and the rear end of which forms a second, movable or moving handle 12 situated beneath the stationary handle 5.

The mechanism 8 also comprises a link 13, the front end of which is articulated at an intermediate point along the lever 10 by a pivot 14, and the rear end of which carries a pivot 15. This pivot passes through elongate slots along the overall axis of the handle 5, and these slots are provided in the two legs of a clevis piece 16, which forms part of an adjusting device 9. About mid-way along its length, the link 13 has a U-shaped protrusion 17 directed towards the handle 12, which forms a slit 18 at its base. At its front end, this link has a single nesting tooth 19, the front face of which forms an upper arc of a circle 19A that is centered on pivot 14, a lower arc of a circle 19B of smaller radius, and a radial face 19C, pointing downwards, connecting these two arcs. The face 19C, which constitutes the nesting face, is more or less radially extending with respect to the pivot 14.

The adjusting device 9 comprises a nut 20 fixed in the handle 5, a screw 21 which passes through the nut, and an operating knob 22. The front end of the screw passes, able to rotate freely, through the web of the clevis piece 16 and, within it, is equipped with a head against which the rear end of the link 13 can rest. The rear end of the screw 21 forms a square or a hexagon 23 slidably received within a matching recess in a sleeve 25. The knob 22 is fixed to the sleeve in such a way that an internal flange 26 of the handle 5 is trapped between the knob and an external flange 27 of the sleeve 25. Thus, the operating knob is mounted so that it can be rotated, but is incapable of translational movement, at the rear end of the handle 5.

The mechanism 8 also comprises a locking/unlocking catch 28 articulated to the lever 12 by a pivot 29 close to the pivot 14. On its inner side, pointing towards the handle 5, the catch 28 has a recess delimited at the top by an upper triangular tooth 30 which forms a single nesting tooth, and at the bottom by a lower triangular stop tooth 31. The upper edge 31A of the latter is radial with respect to the pivot 29. Furthermore, at its front end, close to the tooth 30, the catch 28 has a protrusion 32. In the example of FIGS. 1 to 3, that part of the catch which bears the teeth 30 and 31 and the protrusion 32 consists of a separate attached component. For example, this component may be made of metal and the rest of the catch of plastic.

The mechanism 8 also comprises a multipurpose spring 33. This spring comprises a helical rear part 34 hooked under tension onto the link 13 near to the pivot 15, then a straight part 35 which extends, more or less along the overall axis of the stationary handle 5, as far as the pivot 11, then a hairpin-shaped part 36 which runs around the pivot 11 by one and a half turns. The hairpin shaped part 36 comes to bear on the protrusion 32 of the catch 28, tending to make this catch rotate in the clockwise direction about the pivot 29.

The way in which the locking grips, thus described, work is as follows.

To start off with, the locking grips are in their wide-open position depicted in FIG. 1, in which the face 19C of the link is resting against the face 31A and the tooth of the catch 30 is resting against the face 19A of the link. This prevents the two handles from moving further apart from one another. This engagement is sustained thanks to the resting of the end 36 of the spring 33 and to the tension in its helical part 34, which urges the moving jaw 6 open. The rear part 28A of the catch 28 forms a trigger which protrudes slightly beneath an intermediate part of the lever 10.

When the adjusting device 9 is in the state depicted, the screw 21 is screwed forward almost to its maximum extent. This is made visible, if there is no sheath covering this part, by the fact that the ends of the pivot 15 are guided in two longitudinal slots 37(FIG. 2) in the handle 5 and lie almost at the front end of these slots. This setting corresponds to the clamping of an object 38 of minimum thickness, for example 1 mm thick, as depicted in FIG. 3.

In order to grip the object 38, the operator, using all four fingers, pulls up the handle 12 to bring it closer to the handle 5 (direction F in FIG. 1), which is wedged firmly in the palm of the operator's hand. The angle 11-14-15 gradually widens, and the moving jaw 6 moves closer to the stationary jaw 4, tensioning the part 34 of the spring 33, until the object 38 is gripped. At the same time, the tip of the tooth 19 moves closer to that of the tooth 30, and contact between the tip of the tooth 30 and the arc 19A, and between the tip of the tooth 31 and the arc 19B being permanently sustained thanks to the part 36 of the spring. Throughout this movement, the catch 28 is immobilized with respect to the lever 10, which means that the trigger 28A also forms a purchase for the operator's index finger.

By continuing to move the two handles closer together, the operator increases the angle of the latch lock mechanism a little more and causes the tooth 30 to snap-fasten behind the tooth 19, as depicted in FIG. 3. The upper face of the tooth 30 is then more or less radial with respect to the pivot 14, and the stresses due to clamping tend to widen the angle formed by the pin 29, the tip of the tooth 30 and the pin 14. The tip of the tooth 30 then butts against the surface 19B of the link and prevents such widening. The tool has now reached its stable clamped position, for which the angle 11-14-15 is slightly less than 180°, and typically on the order of 170 to 175°. In this position, the trigger protrudes further beneath the lever 10. The snap-fastening can thus be felt by the operator's index finger.

The front end of the link 13 then urges the part 35 of the spring 33 towards the handle 5 (upwards in FIG. 3), so that this part 35 presses the teeth 19 and 30 against one another with a force which is more or less at right angles to the straight line 11–15. If the operator continues to bring the handle 12 up, the lever 10 will butt against the protrusion 17 of the link 8 before the points 11, 14 and 15 come into alignment. This guarantees that movement never goes beyond this point of alignment. Once the operator has released the handle 12, the tool returns to its stable clamped position, because of the action of the spring 33.

The device 9 can be set in two types of ways. For relatively gentle clamping, the snap-fastening 19-13 occurs before the slit 18 of the link is closed, which means that it is the latter's compressive longitudinal elasticity, predetermined by the geometry of its U-shaped protrusion, which defines the amount of clamping. This varies only little throughout the corresponding range of adjustment.

By contrast, for stronger clamping, corresponding to greater advancement of the screw 21, the slit 18 closes up before snap-fastening 19-30 occurs, and this makes it possible for the object 38 to be clamped far more firmly.

To release the object 38, the operator takes hold of the locking grips, brings their handles slightly closer together until 10 17 abutment is achieved. With the operator's index finger, he presses on the trigger 28A and this disengages the tooth 30 from the tooth 19, he then lets go of the handle 12 to allow the locking grips to open by themselves. This opening takes place under the action of the part 35 of the spring 33, which pushes on the middle point 14 of the latch lock mechanism and its part 34, which brings the ends closer together. The wide-open position is defined by the surface 19C of the link and face 31A of the catch coming into abutment with one another.

Thus, the elastic energy stored up upon clamping is released while the operator is gripping the locking grips tightly, and this prevents any explosive reaction in his hand.

In special conditions regarding the accessibility of the workpieces to be clamped, the operator may use the grips upside down with his palm on the branch 12, two to four fingers on the branch 5, and his thumb on the trigger 28A.

Figure 4:
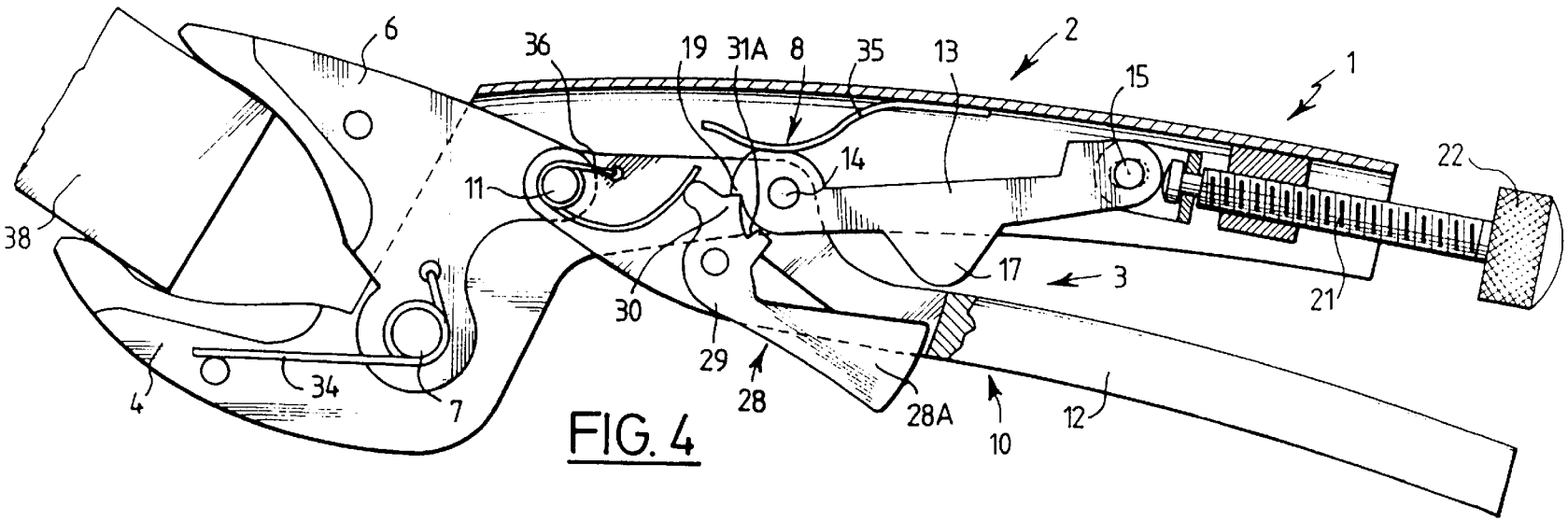
FIG. 4 is a view similar to FIG. 3 of an alternative form of the locking grips, in their position for clamping an object the thickness of which is close to a maximum value.

FIG. 4 depicts an alternative form which differs from the previous one only in the following aspects:

- the screw 21 is simply secured to the knob 22, which means that the latter is a variable distance away from the rear end of the handle 5, depending on the setting chosen;
- the spring 33 has been split into three springs, each one fulfilling one of the functions described above: a spring 34, wound around the pivot 7, for moving the moving jaw away from the stationary jaw; a leaf spring 35 fixed in the handle 5 for urging the front end of the link away from this handle in the clamped position; and a hairpin-shaped spring 36 surrounding the pivot 11 for urging the front end of the catch 28 towards that of the link;
- the catch 28 is made of one piece; and
- the link 13 is rigid, that is to say that the slit 18 is omitted.

This alternative form works in the same way as the previous one, except that because of the rigidity of the link, there is no easy-to-obtain gentle clamping range unless, of course, flexibility is created in some other tensioned part of the grips.

FIG. 4 depicts the tool in its stable position for clamping an object 38 of maximum thickness (in practical terms, a few centimeters). In this case, the screw 21 is almost fully unscrewed, that is to say it is unscrewed far enough that the pivot 15 is brought close to the rear end of the slots 37, as depicted in FIG. 5.

Figures 5, 6, 6A, 7, 8, 9:
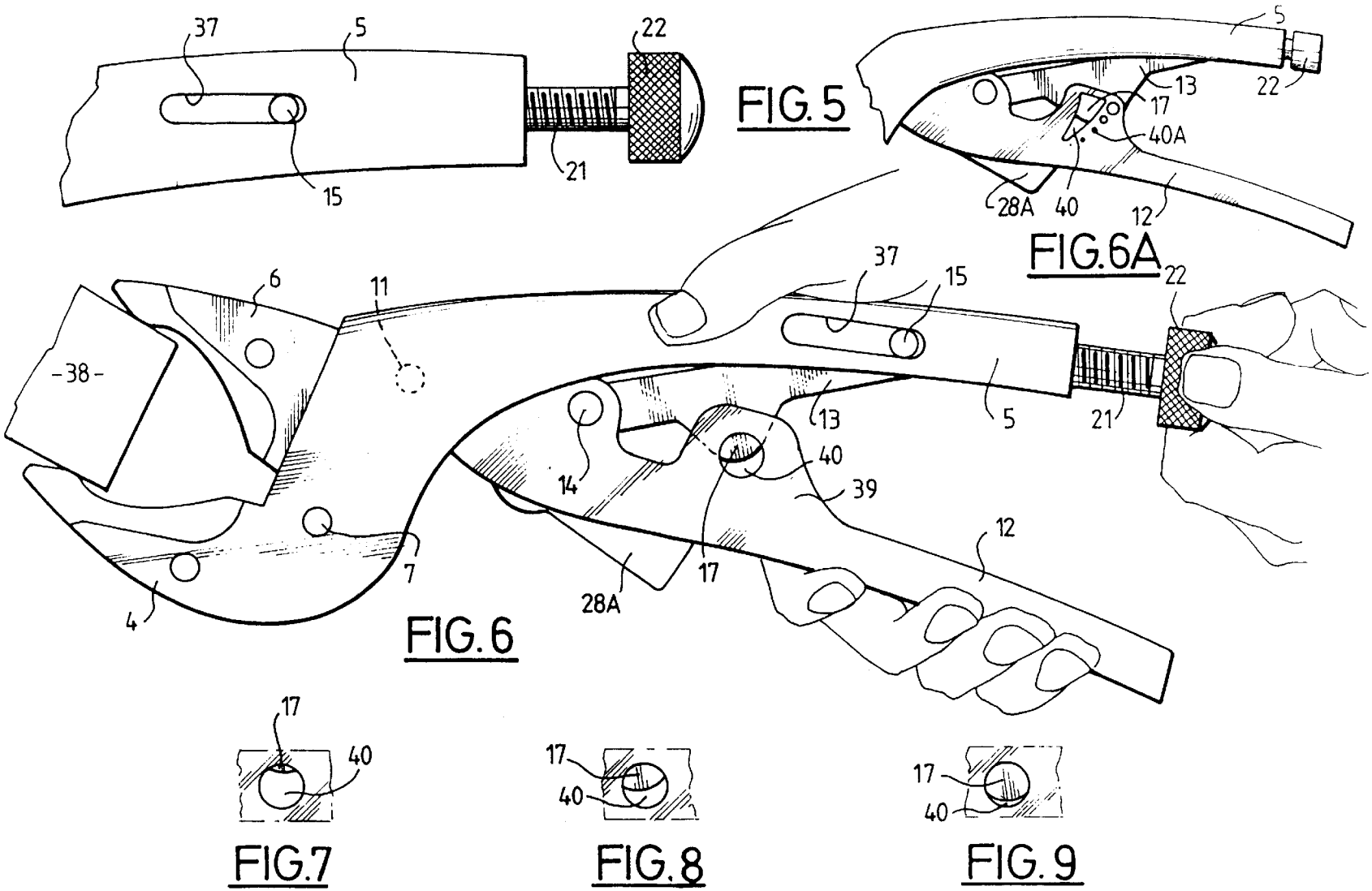
FIG. 5 is a view similar to FIG. 2 but corresponding to the adjustment of FIG. 4.
FIG. 6 is an exterior view of an alternative form equipped with an indicator that indicates the amount of clamping.
FIG. 6A is a partial view of an alternative form.
FIGS. 7 to 9 are partial views illustrating the use of the clamping indicator of FIG. 6.

FIG. 6 depicts an alternative form of the locking grips of FIG. 4, equipped with an indicator that indicates the amount of clamping. For that, the lever 10 has a protrusion 39 that projects towards the handle 5 and is pierced with a hole 40. When the operator, effortlessly, brings the handle 12 closer to the handle 5 and grips the object 38 without exerting any appreciable clamping force, the protrusion 17 of the link becomes visible to a greater or lesser extent through the hole 40, and this visibility can be changed by turning the knob 22 in one direction or the other. Accordingly, the emptier the hole 40, the stronger the final clamping.

It will not be possible to see the indicator 40-17 unless the following two conditions are simultaneously satisfied:

1) jaws 4 and 6 are in contact with the workpiece; and
2) a very gentle force is applied to the handles 5 and 12, i.e. just enough force to overcome the spring and keep the jaws in contact with the workpiece.

The indicator indicates, even though the workpiece has not yet been clamped, how much clamping force will be obtained after the clamping operation has been carried out to reach the stable position in which the teeth 19 and 30 are snap-fastened together.

The hole 40 may be provided in protrusions 39 situated on both sides of the protrusion 17, so that the indicator will be clearly visible from both sides of the grips. These protrusions 39 then form the two perforated legs of a clevis piece receiving the protrusion 17.

Thus, the indicator can be looked at by a left-handed or by a right-handed individual. It can also be looked at when the grips are being used in the upside-down position, with the operator's thumb on the trigger.

The example of FIGS. 6, 7, 8 and 9 shows a protrusion 17 of circular shape and a hole of circular shape. As an alternative, the indicator may consist of a protrusion 17 and a hole 40 of varying shapes.

Thus, another example is illustrated in FIG. 6A, with different shapes and a marking 40A indicating the decreasing nature of the resulting tension, as has been explained with reference to FIGS. 7, 8 and 9.

By way of example, FIGS. 7 to 9 illustrate three scenarios, but all the intermediate or extrapolated degrees of clamping can be obtained by turning the screw 22 to greater or lesser extent.

In FIG. 7, the hole 40 is almost clear, and final clamping will be firm;

In FIG. 8, the hole 40 is about half filled by the protrusion 17, and final clamping will be moderate; and In FIG. 9, the hole 40 is almost completely filled by the protrusion 17, and final clamping will be light.

Figure 10:
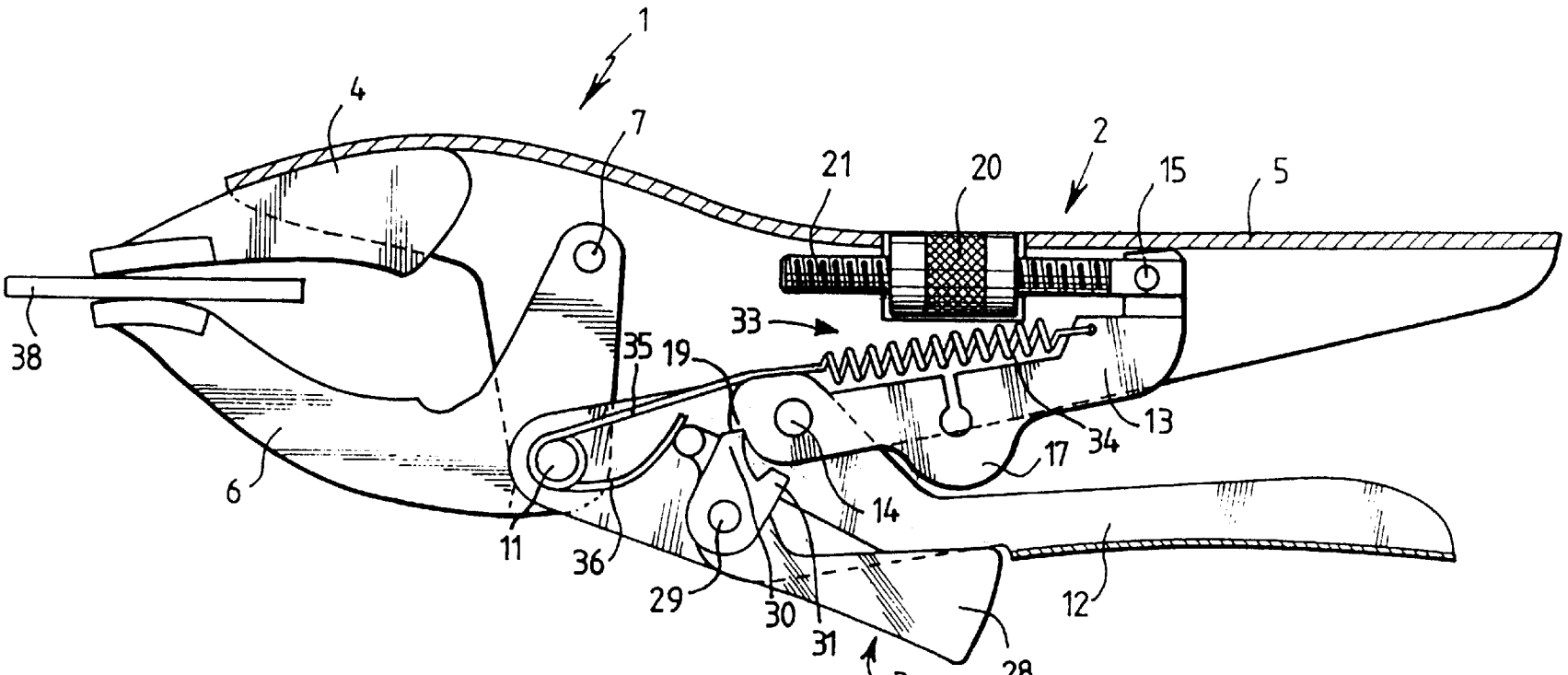
FIG. 10 is a view similar to FIG. 3 relating to another embodiment of the locking grips according to the present invention.

FIG. 10 depicts the application of the invention to locking grips the overall configuration of which is the opposite of the previous arrangement. In particular, the stationary jaw 4 is in line with the handle 5, and the moving jaw 6 is on the same side of the straight line connecting the pivots 7 and 15 as the lever 10. Furthermore, the screw 21 extends forwards, in the handle 5, from the pivot 15 (possibly with the use of a clevis piece as before), and the nut 20 is a cylindrical knurled knob mounted so that it can rotate but is incapable of translational movement, more or less at a mid-way point along the stationary parts 2.

The screw thread on the screw 21 and the nut 20 may be a single thread or a double thread, known per se.

The way in which this embodiment works and its properties are the same as what has been described earlier with reference to FIGS. 1 to 3.

The invention can be extended to cover any type of locking grips, for example such as those disclosed in FR-A-2,237,730.

It should be noted that in each embodiment, the locking grips can be stored closed, simply by bringing the handles together, without it being necessary to operate the adjusting screw. The grips can therefore be closed for storage using just one hand, whereas for conventional grips two hands are needed, one to turn the adjusting screw and the other to close the grips.

What is more, the grips can be closed for storage more quickly, in a single action, because there is no need to turn the adjusting screw.

Locking grips in general, and the locking grips according to the invention in particular, can be made of cut, stamped, pressed then assembled sheet metal. Thus, the handles especially, are usually provided with sheaths made of synthetic resin (plastic) to make them comfortable and ergonomic during clamping.

Locking grips are often used for bringing together workpieces and holding them with a view to welding them. In such scenarios, there are showers of weld or welding slag which is still hot and the plastic sheath becomes encrusted with these; this soon causes the sheath to deteriorate, but more importantly may cause injury to the operator's hand in a subsequent operation.

Figure 11:
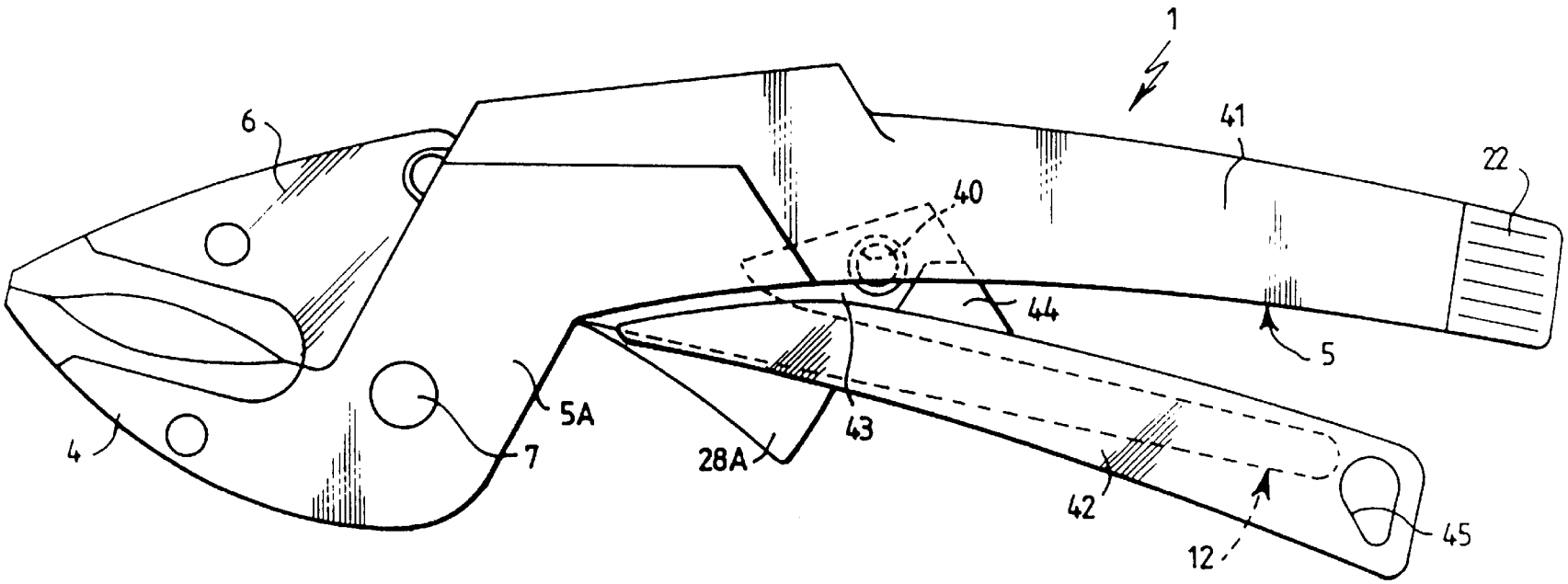
FIG. 11 is an exterior view of an alternative form of the locking grips of FIG. 6.

The embodiment of FIG. 11, on the other hand, uses cast aluminium-alloy or aluminium sheaths:

which cannot become encrusted with showered weld material;

which do not deteriorate when they come into contact with hot workpieces;

and which despite everything, are still fairly light.

The upper sheath 41, pushed over the handle 5 as far as where it joins the intermediate part 5A, protects the mechanism (latch lock, spring, teeth 19 and 30) as far as the parts right next to the jaws, laterally and over the top of the tool.

The lower sheath 42, pushed over the handle 12 may additionally have upwardly projecting reliefs which engage between the metal sheets of the handle 5 to fulfil functions such as:

clamping indicator (hole 40), on one leg 43;

stop 44, interacting with the link as before, to prevent the latch lock mechanism from going beyond the point of alignment upon clamping.

As depicted, the sheath 42 may have a hole 45 so that the tool can be hung up.

What is claimed is:

1. Locking grips comprising:

a stationary assembly having an elongated overall shape, wherein one end of said stationary assembly forms a stationary handle, and the other end of said stationary assembly forms a stationary jaw;

a movable assembly including an operating lever and a movable jaw that is supported on said stationary jaw via a first pivot, said operating lever having a front end that is supported on said movable jaw via a second pivot, and a rear end that forms a movable handle;

a spring for biasing said stationary jaw and said movable jaw away from each other; and a link having a front end supported on said operating lever via a third pivot at an intermediate point along said operating lever, and a rear end supported on said stationary handle at a resting point that is adjustable along a length of said stationary handle, wherein said link and a portion of said operating lever that extends between said second and third pivots defines a toggle mechanism; and stop means for preventing the toggle mechanism from going beyond a point of alignment of the toggle mechanism upon movement of said movable handle toward said stationary handle, wherein:

said link and said operating lever comprise respective stable clamping reliefs that are adapted to nest with each other in a nested position just before said stop means operates to prevent the toggle mechanism from moving beyond the point of alignment; and said clamping relief of said link is supported by a front end of said link, and said clamping relief of said operating lever is connected to a trigger for releasing said clamping reliefs from the nested position thereof, said trigger being located within reach of an operator's index finger when the operator is exerting a clamping force on said movable handle.

2. The locking grips as claimed in claim 1, wherein said trigger is pivotally mounted on said operating lever by a fourth pivot so that said trigger can be pushed into said lever when the nested position of said clamping relief of said link and said clamping relief of said operating lever is to be released.

3. The locking grips as claimed in claim 1, wherein said clamping relief of said link comprises a first tooth, and said clamping relief of said operating lever comprises a second tooth, wherein said first tooth is rigidly connected to a movable catch, and a part of said movable catch forms said trigger.

4. The locking grips as claimed in claim 3, wherein said movable catch is immobilized with respect to said lever in all positions of the toggle mechanism other than the nested position of said first and second teeth.

5. The locking grips as claimed in claim 4, wherein said immobilization of said movable catch is achieved by one part of said movable catch resting on an arcuate surface of said first tooth, said arcuate surface being centered on said third pivot.

6. The locking grips as claimed in claim 3, wherein said movable catch has a second relief that, in cooperation with a surface of said tooth of said link, forms a stop for the opening of the locking grips.

7. The locking grips as claimed in claim 6, wherein said tooth on said movable catch is elastically urged toward the tooth of said link by said spring.

8. The locking grips as claimed in claim 3, wherein said spring presses on a portion of the toggle mechanism when said teeth are engaged.

9. The locking grips as claimed in claim 8, wherein in the nested position of said teeth, retaining surfaces of said teeth are oriented substantially radially with respect to said third pivot.

10. The locking grips as claimed in claim 9, wherein said spring comprises means for constantly elastically urging said toggle mechanism in an opening direction.

11. The locking grips as claimed in claim 10, wherein in the nested position of said teeth, said retaining surfaces of said teeth are oriented substantially radially with respect to said third pivot.

12. The locking grips as claimed in claim 1, wherein said link of said toggle mechanism has compressive longitudinal elasticity over a predetermined compression length.

13. The locking grips as claimed in claim 12, wherein said stop means comprises a U-shaped protrusion formed on said link, and wherein said U-shaped protrusion provides the compressive longitudinal elasticity of said link.

14. The locking grips as claimed in claim 13, further comprising an indicator formed as an integral part of said lever, wherein said stop means comprises a protrusion formed on said link, and said protrusion is movable with respect to said indicator in order to provide a visual indication of a final amount of clamping when a workpiece is gripped between said movable jaw and said stationary jaw with no clamping force applied.

15. The locking grips as claimed in claim 14, wherein said indicator comprises a clevis piece having two legs, each of said legs being perforated, and said protrusion is located between said legs.

16. The locking grips as claimed in claim 1, wherein said stationary handle and said movable handle are both covered with aluminum or aluminum-alloy sheaths.

17. Locking grips comprising:

a stationary assembly having an elongated overall shape, wherein one end portion of said stationary assembly forms a stationary handle, and the other end of said stationary assembly forms a stationary jaw;

a movable assembly including an operating lever and a movable jaw mounted on said stationary jaw by means of a first pivot, said operating lever having a front end that is supported on said movable jaw by a second pivot, and a rear end that forms a movable handle;

a first spring for biasing said stationary jaw and said movable jaw away from each other; and a link having a front end that is supported via a third pivot on an intermediate position of said operating lever, and a rear end that is supported via a fourth pivot on said stationary handle such that a position of said fourth pivot is adjustable along a length of said stationary handle, wherein said link and a portion of said operating lever extending between said second and third pivots defines a toggle mechanism; and a stop, provided on one of said operating lever and said link, for limiting movement of said movable handle toward said stationary handle in order to prevent the toggle mechanism form moving beyond an aligned position thereof, wherein:

said link and said operating lever comprise stable clamping reliefs, respectively, and said clamping reliefs are adapted to nest in a nested position just before said stop operates to limit movement of said movable handle; and said clamping relief of said link is formed on a front end of said link, and said clamping relief of said operating lever is connected to a trigger for releasing said reliefs from the nested position thereof.

18. The locking grips as claimed in claim 17, further comprising a second spring secured to said stationary handle and engaging the front end of said link for biasing the front end of said link away from said stationary handle.

19. The locking grips as claimed in claim 18, further comprising a third spring surrounding said second pivot for urging the clamping relief of said operating lever towards the front end of said link.

20. The locking grips as claimed in claim 17, further comprising an adjusting device disposed in said stationary handle, wherein said adjusting device is operable to adjust the position of said fourth pivot along said stationary handle.

* * * * *

UNITED STATES PATENT AND TRADEMARK OFFICE

CERTIFICATE OF CORRECTION

PATENT NO. : 6,227,080 B1
DATED : May 8, 2001
INVENTOR(S) : Grayo et al.

It is certified that error appears in the above-identified patent and that said Letters Patent is hereby corrected as shown below:

Title page,
Item [54], Title, please delete "VICE-GRIP PLIERS", correct title to read -- LOCKING GRIPS --.

Signed and Sealed this

Fifth Day of March, 2002

*Attest:*

*Attesting Officer*

JAMES E. ROGAN
*Director of the United States Patent and Trademark Office*